US009522769B2

(12) United States Patent
Itzek et al.

(10) Patent No.: US 9,522,769 B2
(45) Date of Patent: Dec. 20, 2016

(54) PUSH-PULL CLOSURE FOR A DRINK CONTAINER

(75) Inventors: Eckhard Itzek, Gyhum-Nartum (DE); Bjoern Frederik Seidler, Scheessel (DE); Ralf Holschumacher, Elsdorf (DE)

(73) Assignee: MAPA GMBH, Zeven (DE)

( * ) Notice: Subject to any disclaimer, the term of this patent is extended or adjusted under 35 U.S.C. 154(b) by 0 days.

(21) Appl. No.: 12/993,063

(22) PCT Filed: May 6, 2009

(86) PCT No.: PCT/EP2009/003222

§ 371 (c)(1),
(2), (4) Date: Jun. 9, 2011

(87) PCT Pub. No.: WO2009/138183

PCT Pub. Date: Nov. 19, 2009

(65) Prior Publication Data

US 2011/0303630 A1 Dec. 15, 2011

(30) Foreign Application Priority Data

May 16, 2008 (DE) ..... 10 2008 023 904

(51) Int. Cl.
*B65D 39/00* (2006.01)
*B65D 47/24* (2006.01)

(52) U.S. Cl.
CPC ..... *B65D 47/247* (2013.01)

(58) Field of Classification Search
CPC ..... B65D 47/247; B65D 39/16
USPC ..... 220/254.3–254.5, 233; 215/361, 311, 215/229; 222/153, 521, 525, 545; 239/541
See application file for complete search history.

(56) References Cited

U.S. PATENT DOCUMENTS

| | | | | |
|---|---|---|---|---|
| 2,969,168 | A * | 1/1961 | Newby | 222/525 |
| 3,107,829 | A * | 10/1963 | Makowski | 222/525 |
| 3,191,806 | A * | 6/1965 | Schultz et al. | 222/41 |
| 3,276,640 | A * | 10/1966 | Kessler | 222/525 |
| 3,738,545 | A * | 6/1973 | Roy | 222/525 |

(Continued)

FOREIGN PATENT DOCUMENTS

| | | |
|---|---|---|
| DE | 19937754 A1 | 2/2001 |
| FR | 2731680 A1 | 9/1996 |
| WO | 9503227 | 2/1995 |

*Primary Examiner* — Anthony Stashick
*Assistant Examiner* — James M Van Buskirk
(74) *Attorney, Agent, or Firm* — Vidas, Arrett & Steinkraus, P.A.

(57) ABSTRACT

Push-pull closure for a drink container comprising a body element which comprises a through-opening and a fastening device, with which it may be sealingly and releasably connected to an opening of the drink container, a mouthpiece which may be axially displaceably inserted into the through-opening of the body element and which comprises at least one locking portion which may engage behind the through-opening of the body element, and a locking element which may be releasably attached to the inner face of the body element facing the drink container, the locking element being arranged so that the locking portion of the mouthpiece may not adopt a position in which it does not engage behind the through-opening of the body element, when the mouthpiece is inserted into the through-opening and the locking element is attached to the inner face of the body element.

17 Claims, 2 Drawing Sheets

(56) References Cited

U.S. PATENT DOCUMENTS

| | | | | | |
|---|---|---|---|---|---|
| 3,777,936 | A * | 12/1973 | Hazard | | 222/48 |
| 4,448,316 | A * | 5/1984 | Hiroshige | | 215/388 |
| 5,022,562 | A * | 6/1991 | Lurkis et al. | | 222/182 |
| 5,145,094 | A | 9/1992 | Perlmutter | | |
| 5,337,931 | A * | 8/1994 | Kitterman | | 222/525 |
| 5,456,374 | A * | 10/1995 | Beck | B65D | 41/3447 215/251 |
| 5,603,436 | A * | 2/1997 | Leoncavallo et al. | | 222/525 |
| 5,651,471 | A | 7/1997 | Green | | |
| 6,050,433 | A * | 4/2000 | Russell et al. | | 215/229 |
| 6,286,733 | B1 | 9/2001 | Francois | | |
| 6,874,664 | B1 | 4/2005 | Montgomery | | |
| 7,690,524 | B2 * | 4/2010 | Chau | | 220/254.3 |
| 2006/0255036 | A1 | 11/2006 | Chau | | |

* cited by examiner

A–A

–B–

PUSH-PULL CLOSURE FOR A DRINK CONTAINER

The invention relates to a push-pull closure for a drink container, in particular for a drinking bottle or a drinking cup. A push-pull closure has a mouthpiece which is accessible from outside and which is arranged axially displaceably on a body element connected to the drinking bottle or drinking cup and may be moved to and fro between an open position and a closed position, in particular by means of the teeth. Generally, the closure is closed by pushing in the mouthpiece (push) and opened by pulling out the mouthpiece (pull). Such push-pull closures are characterised in that the hands are generally not required for opening and closing the closure. Thus they are widely available, in particular in the field of sports, namely in drinking bottles for cycling. Due to the easy handling, however, push-pull closures are also well-suited for many other leisure activities and, in particular, for children.

A push-pull closure is disclosed in the publication DE 199 37 754 A1 comprising a body element which may be positioned on a drinking bottle. An axially displaceable mouthpiece with a through-opening is arranged in a through-opening of the body element, and which is closed by a pin in a first, lower position relative to an upright bottle. The pin is fixedly connected to the body element. In a second upper position of the mouthpiece, the pin opens up the through-opening of the mouthpiece, so that a beverage is able to flow out. The mouthpiece has a radially protruding flange on which two projections are formed. Said projections cooperate with two resilient webs which are formed on the body element, so that the mouthpiece engages in its closed position and may only be pulled out by compressing the two resilient webs with the teeth, in order to open the closure.

A further push-pull closure for a drinking bottle is disclosed in the publication U.S. Pat. No. 5,651,471. This known closure has a pin connected integrally to a body element, and which protrudes from below into an axially displaceable mouthpiece, and closes a drinking opening arranged at the upper end of the mouthpiece when the mouthpiece is located in a lower position. The mouthpiece extends through a through-opening of the body element and has at the lower end of the mouthpiece outwardly-oriented projections which engage behind the through-opening and prevent the mouthpiece from slipping out of the body element.

A further push-pull closure is disclosed in the publication U.S. Pat. No. 6,874,664 B1 for a drinking bottle in which a tubular portion protruding upwardly is formed on a body element, onto which a mouthpiece is axially displaceably positioned so that it encompasses the tubular portion. Thus, outside on the tubular portion pivotable tabs are formed which cooperate with further pivotable tabs which are formed on the inner face of the mouthpiece. When positioning the mouthpiece onto the tubular portion during the mounting of the closure, the tabs in each case fold up and slide past one another. Then the tabs form a stop which prevents the mouthpiece from being pulled off the tubular portion.

A push-pull closure is disclosed in the publication U.S. Pat. No. 6,286,733 B1 which also has a tubular body element portion and an axially displaceable mouthpiece encompassing said body element portion. A protective cap holds the mouthpiece in the closed position when it is positioned on the closure. An opening of the mouthpiece at the upper end is closed by a pin which is fixedly connected to the body element.

A drinking bottle is disclosed in the publication US 2006/0255036 A1 comprising a body element with a push-pull closure which may be screwed-on. A two-part pivotable protective cap may be closed via the push-pull closure. An axially displaceable mouthpiece is inserted into a tubular portion of the body element. In the vicinity of the lower end of the mouthpiece a peripheral flange is arranged which prevents the mouthpiece from being completely pulled out.

Proceeding therefrom, it is the object of the invention to provide an improved push-pull closure which, in particular, is easy to clean, prevents the mouthpiece from being entirely pulled out inadvertently and may be produced cost-effectively.

This object is achieved by the push-pull closure for a drink container having the features of Claim 1. Advantageous embodiments are provided in the accompanying subclaims.

The push-pull closure according to the invention comprises

- a body element which comprises a through-opening and a fastening device with which it may be sealingly and releasably connected to an opening of the drink container,
- a mouthpiece which may be axially displaceably inserted into the through-opening of the body element and which comprises at least one locking portion which may engage behind the through-opening of the body element, and
- a locking element which may be releasably attached to the inner face of the body element facing the drink container,
- the locking element being arranged so that the locking portion of the mouthpiece may not adopt a position in which it does not engage behind the through-opening of the body element, when the mouthpiece is inserted into the through-opening and the locking element is attached to the inner face of the body element.

The body element may, for example, be a cap or a lid which closes the drink container. As a fastening device, for example, it may have an internal thread which may be screwed onto an external thread on the drink container, a flange which is pressed by a retaining ring onto an opening edge of the drink container, or a resilient annular portion which encompasses the opening edge of the drink container in a clamped manner, as in a snap closure. The body element or the opening edge of the drink container may be provided with a separate seal. The body element has an inner face, which faces the drink container in the state connected to the drink container and an outer face remote from the drink container. The drink container is, in particular, a drinking bottle or a drinking cup, in particular in an embodiment adapted to the requirements of children.

The mouthpiece may be substantially tubular and may comprise a peripheral bead at the upper end which facilitates the grasping of the mouthpiece using the teeth. Preferably, the mouthpiece is made from a relatively soft material, in particular a relatively soft thermoplastic elastomer. "Relatively soft" means, in particular, soft in comparison with the material of the body element and/or the locking element. This may facilitate an effective seal and additionally convey a pleasant drinking sensation.

In order to assemble the push-pull closure, in a first step the mouthpiece is inserted into the body element, preferably from the outside. At the same time the at least one locking portion is passed through the through-opening of the body element. The at least one locking portion may form a stop which cooperates with the inner face of the body element when the mouthpiece is pushed towards the outer face of the body element. The locking portion may be resilient and after passing through the through-opening of the body element may automatically reach its position engaging behind the through-opening. As a result, an automatic engagement of the mouthpiece in the body element is achieved, independently of the locking element, which facilitates the assembly of the closure. In particular, the mouthpiece is prevented from being pushed out when inserting the locking element.

In a second mounting step, the locking element is attached to the inner face of the body element. The locking element attached to the body element ensures that the at least one locking portion may not reach a position in which it does not engage behind the through-opening of the body element. It is, therefore, impossible to pull out the mouthpiece completely from the body element when the locking element is attached. The mouthpiece is positively anchored. As a result, the mouthpiece is reliably prevented from being lost during use and undesirable spilling of liquid and any injury by potentially swallowing the mouthpiece when drinking are also prevented.

In the assembled state of the push-pull closure, the at least one locking portion may be in contact with the locking element and be held thereby in a specific position engaging behind the through-opening, but it may also be arranged at a distance from the locking element and, as a result, merely prevent a displacement to a specific degree of the at least one locking portion from the position engaging behind the through-opening. In particular, between the mouthpiece with the locking portion and the locking element a space may be provided through which the liquid may flow when the closure is open.

In order to clean the push-pull closure it may be pulled apart very easily. To this end, the body element is initially separated from the drink container, so that the locking element is easily accessible on the inner face of the body element. Then the locking element is released from the body element. Subsequently, the mouthpiece may be pulled out of the body element, for which optionally the at least one locking portion may be gripped by the inner face of the body element and may be displaced into a position not engaging behind the through-opening. The three components of the closure which may be separated from one another in this manner with few hand movements may thus be cleaned very easily, in particular the bearing surfaces and sliding surfaces, and optionally the seals against which the individual components bear against one another in the mounted state, being easily accessible. Residues of the beverage and other contaminants are preferably deposited at these points. Due to their relatively simple shape, the individual components are additionally able to be made easily and cost-effectively.

In principle, the attachment of the locking element to the body element may be carried out in any manner, for example by screwing-in, engagement or by a clamped, non-positive fixing. In one embodiment of the invention, the attachment is effected by at least two fastening portions on the locking element, said fastening portions extending in a plane arranged perpendicular to a longitudinal axis of the locking element and being able to be anchored in corresponding receivers on the body element by rotating the locking element relative to the body element. As a result, the locking element may be particularly easily attached to the body element, as in a bayonet closure, with only one hand movement. The locking element may have a symmetrical shape relative to the longitudinal axis with fastening portions opposing one another. The locking element may have a grip portion which simplifies grasping and rotating the locking element. The grip portion may, for example, be a disc-shaped portion arranged in the plane of the longitudinal axis at the lower end of the locking element remote from the fastening portions, Relative directional or positional information such as "above", "below", etc. always refer here and hereinafter to a closure arranged on a drink container standing upright.

In one embodiment, the at least one locking portion is a latching lug, which is formed on the outer face of the mouthpiece and at the lower end thereof. As a result, the mouthpiece may be easily inserted into the through-opening of the body element and automatically engaged.

In one embodiment, the mouthpiece has a through-opening for a beverage and the locking element protrudes at least partially into the through-opening of the mouthpiece when the mouthpiece is inserted into the through-opening of the body element and the locking element is attached to the inner face of the body element. As a result, the desired restriction of mobility of the at least one locking portion may be easily effected by the part of the locking element protruding into the through-opening of the mouthpiece.

In one embodiment, the mouthpiece is substantially cylindrical and on the body element or on the mouthpiece a seal is arranged which, irrespective of the position of the mouthpiece inserted into the body element, effects a seal between the body element and the mouthpiece. The seal may, for example, be an O-ring. This seal has nothing to do with the opening and closing of a drinking aperture and ensures, irrespective of the position of the mouthpiece, that no liquid escapes between the body element and the mouthpiece, even when displacing the mouthpiece.

In one embodiment, the locking element has a closure portion which opens up the through-opening of the mouthpiece in a first position of the mouthpiece inserted into the through-opening of the body element, and closes the through-opening of the mouthpiece in a second position of the mouthpiece inserted into the through-opening of the body element. As a result, a particularly simple design is achieved. In particular, it is not necessary to provide additionally a closure portion connected fixedly to the body element. Preferably, the mouthpiece is displaceable over a specific longitudinal portion and is located in the first position at the upper end of the longitudinal portion, and in the second position at the lower end of the longitudinal portion. On the closure portion or on the portion of the mouthpiece cooperating with the closure portion, a seal may be arranged, for example an O-ring.

In one embodiment, the closure portion is formed on a pin of the locking element which protrudes from below into the through-opening of the mouthpiece when the mouthpiece is inserted into the through-opening of the body element and the locking element is attached to the inner face of the body element. With such a pin which is, in particular, circular, a simple closure of a through-opening in the mouthpiece which is, in particular, circular is possible in a simple manner. Preferably, the closure portion may be arranged on a pin which has a thickening in the region of the closure portion. The pin may widen conically towards the closure portion in order to achieve automatic centring of the mouthpiece. The closure portion may be cylindrical, a seal being able to be provided on the peripheral surface. By forces acting radially from the closure portion onto the mouthpiece, a self-locking of the mouthpiece may be achieved. At the same time, the pin may permit in a simple manner the desired restriction of displaceability of the at least one locking portion.

In one embodiment, the closure portion is formed at the upper end of the pin and terminates approximately flush with the upper end of the mouthpiece when the mouthpiece is in its second position. As a result, a reliable closure of the opening is achieved and at the same time contamination of the through-opening is prevented in the closed state.

In one embodiment, the through-opening of the mouthpiece has a diameter which, at the upper end of the mouthpiece, corresponds to the diameter of the upper end of the pin and widens downwards. The widening may be continuous but is preferably a step-shaped path. In contrast, the pin may have a uniform diameter, in particular, in an upper portion. As a result, when the closure is open, in the first position of the mouthpiece the liquid is able to flow through between the pin and mouthpiece and both components have a simple shape.

In one embodiment, the closure portion is arranged at a distance from the upper end of the mouthpiece when the mouthpiece is in its second position. This arrangement has the advantage that the closure portion and the portion of the mouthpiece cooperating with the closure portion is less prone to a deformation produced, in particular, by chewing on the mouthpiece. As a result, the sealing effect is affected less by the usual occurrence of wear. In one embodiment, the closure portion is arranged at the lower end of the pin.

In one embodiment, the closure portion is arranged below the through-opening of the body element. If the mouthpiece is in its second position, the portion of the mouthpiece cooperating with the closure portion is, therefore, located inside the drink container. At that point, the outer face of the mouthpiece is subjected to the internal pressure in the drink container. As a result, an improved sealing effect is achieved with carbonated drinks and increased internal pressure. This applies, in particular, in the case of a relatively easily deformable mouthpiece.

In one embodiment, two closure portions are provided, spaced apart from one another. As a result, a particularly secure sealing effect of the closure is achieved. Even if one of the two closure portions and/or a portion of the mouthpiece cooperating with said closure portion is damaged, the sealing effect is maintained. Additionally, it is possible to arrange the upper closure portion in the region of the upper end of the mouthpiece. In contrast to a single closure portion at a distance from the upper end of the pin and/or the mouthpiece in its second position, an escape of liquid from a region of the through-opening in the mouthpiece above the closure portion arranged below is, as a result, prevented.

In one embodiment, the first closure portion is formed at the upper end of the pin and the second closure portion is formed below said first closure portion on the pin, the diameter of the pin in the region of the second closure portion approximately corresponding to the diameter of the mouthpiece in this region, when the mouthpiece is in its second position. The pin with the closure portions may be stepped. As a result, a simple shaping is possible with two closure mechanisms arranged on top of one another.

In one embodiment, in the state inserted into the through-opening of the body element, the mouthpiece is arranged to be inclined relative to a longitudinal axis of the body element and the drink container. As a result, a particularly ergonomic shape is achieved which may facilitate completely emptying the drink container, in particular. The closure may be combined with a conventional drink container with horizontal opening. Preferably, the angle of inclination of the mouthpiece is approximately 45 degrees.

In one embodiment, a pivotable flap is provided which covers the mouthpiece in a closed state of the flap. The flap may protect the mouthpiece from contamination and damage, in particular during transport. The flap is pivotably held on the body element and, therefore, may also not be easily separated from the body element in the open state. Thus it may not become mislaid during use, in the manner of a conventional attachable cap.

In one embodiment, the pivotable flap is arranged so that in the closed state it prevents a displacement of the mouthpiece from its second position. As a result, the flap protects from inadvertent opening of the closure, for example as a result of vibrations during transport. In particular, it is provided that the flap in the closed state extends directly above the mouthpiece. As a result, it is additionally ensured that the flap may only be closed when the closure has been previously completely closed. The transport of an open or partially open drink container may be avoided, as a result.

In one embodiment, the pivotable flap has approximately the shape of a segment of a spherical shell, the pivot axis extending approximately through the centre point of the spherical shell. In this case, the flap pivots in a manner similar to the visor of a helmet, approximately in the area defined by the spherical shell, and always remains in the vicinity of the body element. As a result, it is not disturbed during drinking and is less easily damaged.

In one embodiment, the body element above the fastening device is approximately in the shape of a hemispherical shell and has a recess in the region of the through-opening for the mouthpiece. As a result, the mouthpiece is protected both from damage and is also easily accessible. In particular, in combination with the inclined arrangement of the mouthpiece and with the visor-like pivotable flap, the closure has in this embodiment a particularly ergonomic and harmonious shape, both when the flap is open and closed.

In one embodiment, a drink container is present. The drink container may be adapted with regard to its dimensions and other properties to the push-pull closure.

All the embodiments relating to the arrangement and design of the closure portion and/or the closure portions as well as the embodiments with a pivotable flap and/or with a mouthpiece arranged to be inclined are of particular advantage, not only in combination with the three-part construction of the push-pull closure according to the invention but they may alternatively be expediently combined with a conventional push-pull closure. In this case, the closure element(s) is(are) not arranged on a specific locking element but generally fixedly connected to the body element. Such a push-pull closure has a body element with a fastening device, by which it may be connected sealingly and releasably to an opening of the drink container and a mouthpiece which is arranged axially displaceably on the body element. As known from the prior art, the body element may either have a through-opening in which the mouthpiece is guided, or a tubular portion, the outer face thereof being encompassed by the mouthpiece.

The invention is described in more detail hereinafter with reference to exemplary embodiments shown in the figures, in which.

Figure 1:
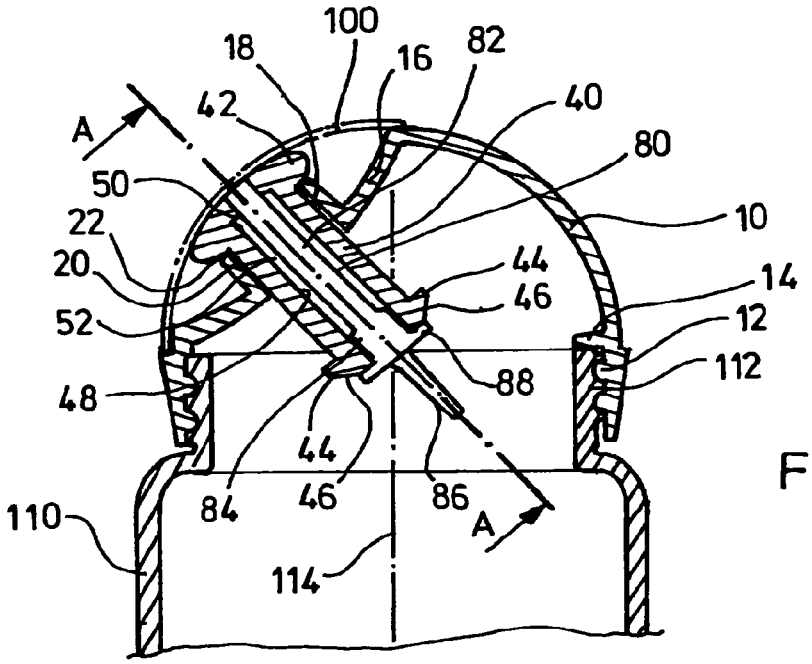
FIG. 1 shows a first exemplary embodiment of a push-pull closure according to the invention with an inclined mouthpiece and pivotable flap in a cross-sectional view.
Figure 2:
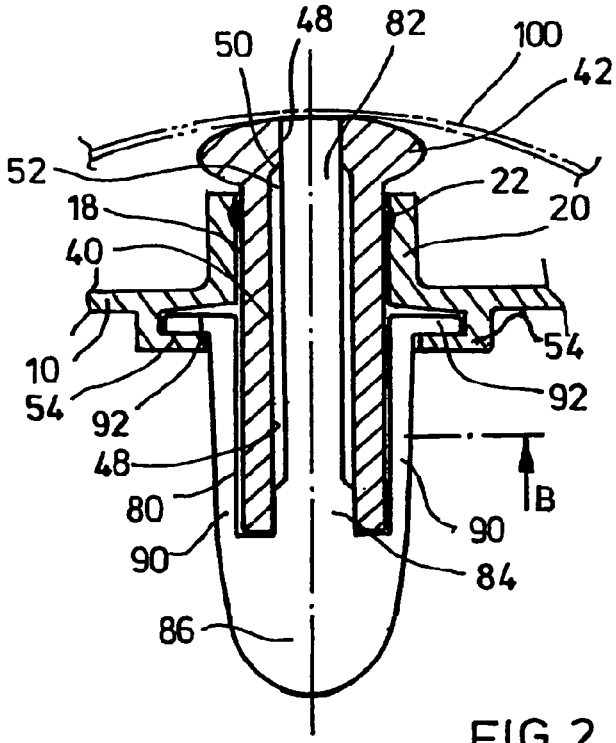
FIG. 2 shows a cross-sectional view along the plane denoted by A-A in FIG. 1.
Figure 3:
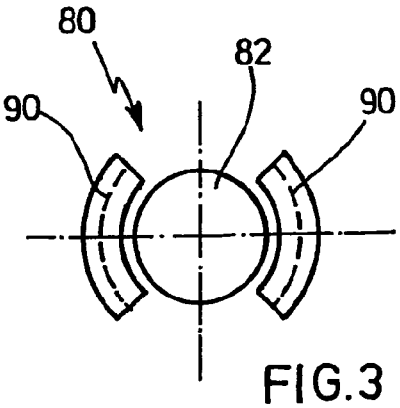
FIG. 3 shows a cross-sectional view through the locking element along the plane denoted in FIG. 2 by B.

The push-pull closure shown in FIGS. 1 to 3 in the assembled and closed state consists of a body element 10, a mouthpiece 40 and a locking element 80. Additionally, it has a pivotable flap 100.

The body element 10 has at its lower end a fastening device in the form of an internal thread 12 which is connected to an external thread 112 on the opening of a drinking bottle 110. A peripheral flange 14 facing inwards on the body element 10 is pressed against the upper edge of the drinking bottle 110 when screwing the body element 10 onto the drinking bottle 110 in order to achieve a seal. Above the internal thread 12, the body element 10 has substantially the shape of a hemispherical shell, the inner face thereof facing the drinking bottle 110. Around the mouthpiece 40, the body element has a recess 16, the shape thereof also describing the segment of a spherical shell of larger diameter. In the middle of the recess 16 the body element 10 has a through-opening 18 into which the mouthpiece 40 is inserted. The through-opening 18 and the mouthpiece 40 are arranged to be inclined relative to the indicated longitudinal axis 114 of the drinking bottle 110 and/or of the body element 10 at an angle of approximately 45 degrees. Around the through-opening 18, a tubular portion 20 of the body element 10 is adjoined externally onto the recess 16. In the vicinity of the upper end of the tubular portion 20 on the internal diameter is located a seal 22 which seals the gap between the mouthpiece 40 and the through-opening 18.

The mouthpiece is of substantially circular cylindrical shape and has at the upper end a bead 42 which simplifies the gripping of the mouthpiece 40 using the teeth. On the external periphery of the lower end of the mouthpiece two opposing locking portions in the form of latching lugs 44 are formed. The latching lugs 44 engage behind the through-opening 18 and form a stop which cooperates with the inner face of the body element 10, when pulling out the mouthpiece 40 from the second position shown in which the closure is closed, into a first position in which the closure is open. The latching lugs 44 have in each case at the lower end a bevel 46 so that when the mouthpiece 40 is inserted into the through-opening 18 of the body element 10 said latching lugs are pressed inwardly and a simple insertion of the mouthpiece 40 is possible.

The mouthpiece 40 has a through-opening 48, the diameter thereof being uniform over the lower portion of the mouthpiece and narrowing at the upper end of the mouthpiece, forming a conical step 50 to a smaller diameter.

The locking element 80 visible most clearly in FIG. 2, has a pin which engages from below in the mouthpiece 40. The pin has an upper portion 82 with a uniform diameter, the upper end thereof terminating flush with the upper edge of the mouthpiece 40 when the mouthpiece 40 is in its second position, as shown. The pin widens at the lower end of the upper portion 82 conically to a larger diameter which remains approximately uniform over a shorter, lower portion 84 of the pin and extends downwards approximately as far as the lower end of the mouthpiece 40, when the mouthpiece 40 is in its second position. The diameter of the upper portion 82 of the pin corresponds to the internal diameter of the through-opening 48 of the mouthpiece 40 at the upper end thereof. Here the upper end of the upper portion 82 of the pin forms a first closure portion. The diameter of the lower portion 84 of the pin corresponds to the internal diameter of the through-opening 48 of the mouthpiece 40 at the lower end thereof. Here the lower portion 84 of the pin forms a second closure portion which is arranged at a distance from the upper end of the mouthpiece 40. The lower portion 84 of the pin may also be slightly conical or provided with a quarter spherical-shaped surface portion in order to achieve an optimal sealing effect relative to the inner face of the mouthpiece 40.

Between the through-opening 48 of the mouthpiece 40 and the upper portion 82 of the pin, an annular gap 52 is located through which the liquid may flow out of the drinking bottle 110, when the mouthpiece is located in a second position, axially displaced upwards, which is not shown in the figures. The annular gap 52 is dimensioned so that the latching lugs 44 of the mouthpiece 40 are not able to reach a position in which they no longer engage behind the through-opening 18 in the body element 10, as long as the locking element 80 is attached to the body element 10 and the mouthpiece is inserted into the through-opening 18. As a result, a complete withdrawal of the mouthpiece 40 from the body element 10 in the assembled state of the closure is impossible.

Below the lower portion 84 of the pin is located an externally facing disc-shaped flange 88 which forms a stop for the lower end of the mouthpiece 40 and limits the mobility of the mouthpiece 40 downwards. A disc-shaped grip portion 86 is adjoined to the flange 88 at the bottom, on which the locking element 80 may be easily grasped and rotated relative to the body element 10. The grip portion 86 extends in the direction of the longitudinal axis of the pin and thus perpendicular to the flange 88.

At a distance from the pin and parallel thereto, the locking element 80 has two opposing webs 90 spaced apart from one another and connected to the pin via the flange 88 and the grip portion 86 which are bent according to the cylindrical mouthpiece 40, and at their upper ends open into two planar fastening portions 92, which are arranged in a plane perpendicular to the longitudinal axis of the pin. The fastening portions 92 cooperate with two corresponding receivers 54 on the body element 10, so that the locking element 80 may be attached to the body element 10 with a simple rotational movement.

In the cross-sectional view of FIG. 3, which only shows a cross section along the plane B of FIG. 2 through the locking element 80, the bent webs 90 and the upper portion 82 of the pin are clearly visible.

The pivotable flap 100 has substantially the shape of a segment of a spherical shell. The diameter of the spherical shell corresponds approximately to the diameter of the concentrically arranged spherical shell describing the body element 10. The pivot axis of the flap 100 extends approximately through the centre of the two spherical shells, so that the flap 100, when pivoted, follows the contour of the body element 10. In the cross-sectional view of FIG. 1, the flap 100 extends over an angle of approximately 90 degrees, fully covering the recess 16 in the closed state shown. On the edges of the recess 16, the flap 100 bears against the outer face of the body element 10. The flap 100 extends directly above the upper end of the mouthpiece 40 or at a short distance therefrom, when the mouthpiece 40 is in its second, lower and closed position. As a result, the flap 100 may only be closed when the mouthpiece is in its closed position. Additionally the closed flap 200 prevents slipping of the mouthpiece and thus inadvertent opening of the closure. When the flap 100 is in the fully open position (not shown in the figures) it bears tightly against the outer face of the body element 10 and completely opens the recess 16.

For the description of the further exemplary embodiments, the same reference numerals are used as in the first exemplary embodiment, provided the denoted parts correspond as regards their shape or function.

Figure 4:
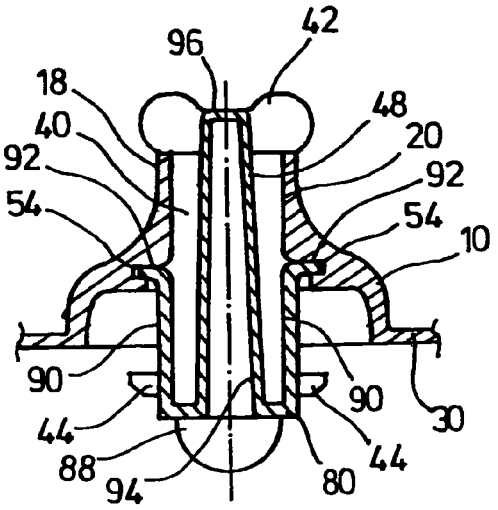
FIG. 4 shows a further exemplary embodiment of a push-pull closure according to the invention in the assembled state in a cross-sectional view.
Figure 5:
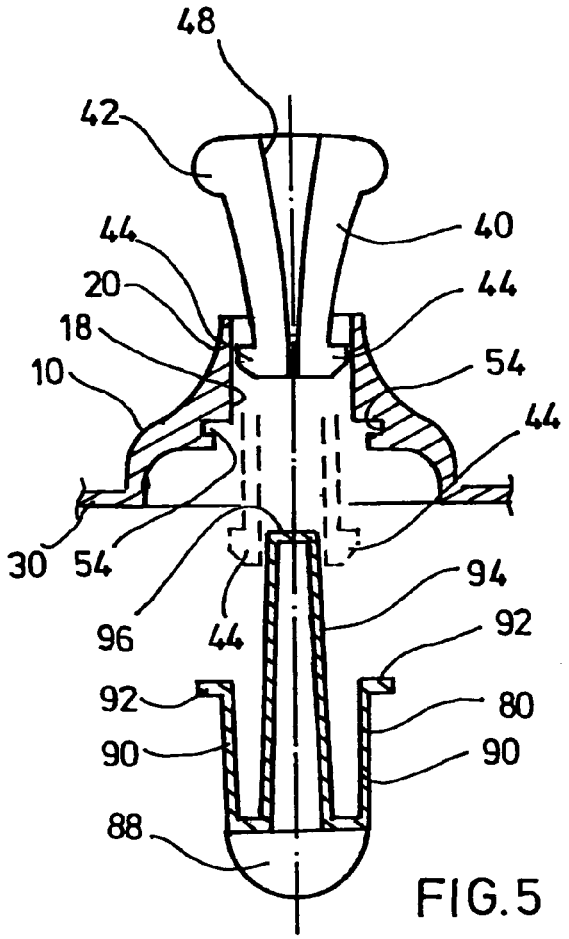
FIG. 5 shows a further cross-sectional view of the closure of FIG. 4 during assembly.

A second exemplary embodiment of a push-pull closure is shown in FIGS. 4 and 5. The body element 10 has as a fastening device a peripheral fastening flange 30 which may be held in a clamped manner by a retaining ring on the opening edge of a drink container. Proceeding from the fastening flange 30, the body element 10 merges in a curved line with a tubular portion 20, which in the inside has a through-opening 18 for receiving the mouthpiece 40. The mouthpiece 40 consists of a relatively soft plastic, in particular of a thermoplastic elastomer, as does the mouthpiece of the first exemplary embodiment. Around the upper edge, the mouthpiece 40 has a bead 42. The mouthpiece 40 has a through-opening 48, the diameter thereof continuously increasing from top to bottom. At the lower end on the outside, the mouthpiece 48 has two opposing latching lugs 44 which engage behind the through-opening 18 in the body element 10 in the undeformed state of the mouthpiece 40, as shown in FIG. 4.

The body element 10 has on the inner face two opposing receivers 54 in which two fastening portions 92 of a locking element 80 are held. The fastening portions 92 are each connected via a web 90 to a grip portion 88 and a pin 94 arranged along the longitudinal axis of the locking element 80. The pin 94 is hollow inside, open at the lower end and closed at the upper end, where it terminates with a disc-shaped portion 96 flush with the mouthpiece 40. The pin 94 is conical, corresponding to the through-opening 48 in the mouthpiece 40, so that it comes into contact with the mouthpiece 40 with its entire peripheral surface, when said mouthpiece is in its lower closed position.

FIG. 5 illustrates the assembly of the push-pull closure. In a first step, the mouthpiece 40 is inserted from above into the through-opening 18 of the body element 10, the latching lugs 44 being pressed together. This state of the mouthpiece is shown in FIG. 5. The mouthpiece 40 is then pushed in as far as possible into the body element 10, the latching lugs 44 in the undeformed state again bending back and engaging behind the through-opening 18 of the body element. This state is shown as a detail in FIG. 5, by dashed lines. Subsequently, in a second step the locking element 80 is inserted from below with the pin 94 into the through-opening 48 of the mouthpiece, as shown in FIG. 5. Subsequently, the locking element 80 is pushed further upwards, and with its fastening portions 92 anchored in the corresponding receivers 54 to the body element by performing a rotational movement. The assembled state of the closure which is shown in FIG. 4 is produced.

Figure 6:
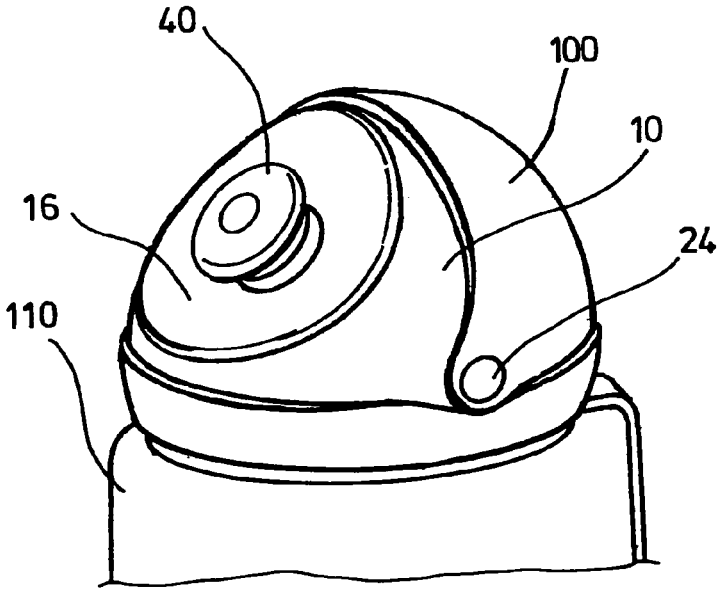
FIG. 6 shows a perspective view of a drinking bottle according to the invention with a push-pull closure.

In the perspective view of FIG. 6, a further exemplary embodiment is shown which substantially coincides with the first exemplary embodiment of the FIGS. 1 to 3. The hemispherical-shaped body element 10 with the recess 16 and the mouthpiece 40 arranged in the centre of the recess 16 may be clearly seen. The body element 10 is placed on a drinking bottle 110. In the vicinity of the lower edge of the hemispherical-shaped portion of the body element 10 on both sides of the body element 10 a short pivot pin 24 is formed on which the flap 100 is pivotably arranged with a corresponding opening. In the open state of the flap 100 shown, said flap is arranged bearing tightly against the upper face of the body element 10, the recess 16 located on the other side of the body element 10 being completely freely accessible. In the closed state the flap 100, however, is pivoted over the recess 16 and runs in the vicinity of the edge thereof or bears thereagainst, so that the recess 16 and, in particular, the mouthpiece 40 are protected from contamination. Moreover, the flap 100 then extends immediately above the upper end of the mouthpiece 40 so that an inadvertent opening of the closure, for example as a result of vibrations, is reliably prevented. A peripheral ring 26 below the pivot pin 24 protrudes slightly from the hemispherical-shaped surface of the body element 10 and forms on both sides a stop for the pivotable flap 100.

In all exemplary embodiments the body element 10, the mouthpiece 40 and the locking element 80 are in each case made in one piece from plastics, in particular in an injection-moulding process.

The invention claimed is:

1. A push-pull closure for a drink container comprising a body element (10) which comprises a through-opening (18) and a fastening device (12), with which it is sealingly and releasably connected to an opening of the drink container (110), a mouthpiece (40) which is axially displaceably inserted into the through-opening (18) of the body element (10) and which comprises at least one locking portion (44) which is engageable behind the through-opening (18) of the body element (10), wherein the at least one locking portion is a latching lug (44), which is formed on the outer face of the mouthpiece (40) and the lower end thereof, and wherein the mouthpiece (40) has a through-opening (48) for a beverage, and a locking element (80), the locking element is separate from the mouthpiece which is releasably attachable to the inner face of the body element (10) facing the drink container (110), the locking element (80) being arranged so that the locking element (80) protrudes at least partially into the through-opening (48) of the mouthpiece (40) when the mouthpiece (40) is inserted into the through-opening (18) of the body element (10) and the locking element (80) is releasably attached to the inner face of the body element (10), and a gap (52) between the locking element (80) and the mouthpiece (40) is dimensioned such that the locking portion (44) of the mouthpiece (40) is not adoptable to a position in which it does not engage behind the through-opening (18) of the body element (10), when the mouthpiece (40) is inserted into the through-opening (18) and the locking element (80) is attached to the inner face of the body element (10), wherein the locking element (80) has at least two fastening portions (92) which extend in a plane arranged perpendicular to a longitudinal axis of the locking element (80), and which is anchored in corresponding receivers (54) on the body element (10) by rotating the locking element (80) relative to the body element (10).

2. The push-pull according to claim 1, wherein the mouthpiece (40) is substantially cylindrical and in that on the body element (10) or on the mouthpiece (40) a seal (22) is arranged which, irrespective of the position of the mouthpiece (40) inserted into the body element (10), effects a seal between the body element (10) and the mouthpiece (40).

3. The push-pull closure according to claim 1, wherein the locking element (80) has a closure portion which opens up the through-opening of the mouthpiece (40) in a first position of the mouthpiece (40) inserted into the through-opening (18) of the body element (10) and closes the through-opening of the mouthpiece in a second position of the mouthpiece (40) inserted into the through-opening (18) of the body element (10).

4. The push-pull closure according to claim 3, wherein the closure portion is formed on a pin (82, 84) of the locking element (80) which protrudes from below into the through-opening of the mouthpiece (40) when the mouthpiece (40) is inserted into the through-opening (18) of the body element (10) and the locking element (80) is attached to the inner face of the body element (10).

5. The push-pull closure according to claim 4, wherein the closure portion is formed at the upper end of the pin (82, 84) and terminates approximately flush with the upper end of the mouthpiece (40) when the mouthpiece (40) is in its second position.

6. The push-pull closure according to claim 3, wherein the through-opening (48) of the mouthpiece (40) has a diameter which, at the upper end of the mouthpiece (40), corresponds to the diameter of the upper end of the pin (82, 84) and widens downwards.

7. The push-pull closure according to claim 3, wherein the closure portion is arranged at a distance from the upper end of the mouthpiece (40) when the mouthpiece (40) is in its second position.

8. The push-pull closure according to claim 7, wherein the closure portion is arranged below the through-opening (18) of the body element (10).

9. The push-pull closure according to claim 3, wherein the closure portion is arranged at the lower end of the pin (82, 84).

10. The push-pull closure according to claim 3, wherein two closure portions are provided, spaced apart from one another.

11. The push-pull closure according to claim 10, wherein the two closure portions include a first closure portion formed at the upper end of the pin (82, 84) and a second closure portion formed below said first closure portion on the pin (82, 84), the diameter of the pin (82, 84) in the region of the second closure portion approximately corresponding to the diameter of the mouthpiece (40) in this region, when the mouthpiece (40) is in its second position.

12. The push-pull closure according to claim 1, wherein the mouthpiece (40) is arranged to be inclined relative to a longitudinal axis of the body element (10) and the drink container (110) when inserted into the through-opening (180 of the body element.

13. The push-pull closure according to claim 1, wherein a pivotable flap (100) is provided which covers and forms a seal over the mouthpiece (40) in a closed state of the flap (100).

14. The push-pull closure according to claim 13, wherein said pivotable flap (100) is constructed and arranged so that in the closed state it prevents a displacement of the mouthpiece (40) from its second position.

15. The push-pull closure according to claim 13, wherein the pivotable flap (100) has approximately the shape of a segment of a spherical shell, the pivot axis extending approximately through the center point of the spherical shell.

16. The push-pull closure according to claim 12, wherein the body element (10) above the fastening device (12) is approximately in the shape of a hemispherical shell and has a recess (16) in the region of the through-opening (18) for the mouthpiece (40).

17. The push-pull closure according to claim 1, wherein a drink container (110) is present.

* * * * *